US009201343B2

(12) United States Patent
Sato

(10) Patent No.: US 9,201,343 B2
(45) Date of Patent: Dec. 1, 2015

(54) DEVELOPMENT APPARATUS AND IMAGE FORMING APPARATUS

(71) Applicant: Oki Data Corporation, Tokyo (JP)

(72) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/630,736

(22) Filed: Feb. 25, 2015

(65) Prior Publication Data

US 2015/0241815 A1 Aug. 27, 2015

(30) Foreign Application Priority Data

Feb. 26, 2014 (JP) ..... 2014-035767

(51) Int. Cl.
*G03G 15/08* (2006.01)

(52) U.S. Cl.
CPC ..... *G03G 15/0865* (2013.01)

(58) Field of Classification Search
USPC ..... 399/107, 110, 119, 120, 252, 258, 265, 399/279, 281
See application file for complete search history.

(56) References Cited

U.S. PATENT DOCUMENTS 6,353,720 B1 * 3/2002 Sakai ..... G03G 15/0808 399/234
8,688,017 B2 * 4/2014 Shimizu ..... G03G 15/0808 399/258

FOREIGN PATENT DOCUMENTS

JP H1039628 A 2/1998

* cited by examiner

*Primary Examiner* — Hoan Tran
(74) *Attorney, Agent, or Firm* — Muncy, Geissler, Olds & Lowe, P.C.

(57) ABSTRACT

A development apparatus includes a developer carrier to develop an electrostatic latent image using a developer, a first and second developer supply members each to supply the developer to the developer carrier. Hs1, Δ1, t1, Hs2, Δ2, and t2 satisfy a following formula below, $$10 \leq Hs1 \times (\Delta 1/t1) + Hs2 \times (\Delta 2/t2) \leq 50$$

Herein, Hs1 is a hardness of the outer peripheral surface of the first developer supply member, t1 is a layer thickness of an elastic layer of the first developer supply member, Δ1 is an NIP amount that is determined when the first developer supply member is in press-contact with the developer carrier, Hs2 is a hardness of the outer peripheral surface of the second developer supply member, t2 is a layer thickness of an elastic layer of the second developer supply member, and Δ2 is an NIP amount that is determined when the second developer supply member is in press-contact with the developer carrier.

4 Claims, 7 Drawing Sheets

*Fig. 5*

| | Circumferential Speed Ratio to OPC (Photosensitive Drum 21) | Circumferential Speed Ratio to DV (Development Roller 23) |
|---|---|---|
| Photosensitive Drum 21 | 1.000 | |
| Development Roller 23 | 1.257 | 1.000 |
| Downstream Side Supply Roller 251 | 0.604 | 0.480 |
| Upstream Side Supply Roller 252 | 0.660 | 0.525 |

*Fig. 6*

| Downstream Side Supply Roller Index A1 \ Upstream Side Supply Roller Index A2 | 1.0 | 1.3 | 1.5 | 1.7 | 2.0 | 2.3 | 2.5 | 3.0 | 3.3 | 3.5 | 3.8 | 4.0 | 4.2 | 5.0 | 5.8 | 6.0 | 6.3 | 6.7 | 7.0 | 7.5 | 8.3 | 8.8 | 10.0 | 11.3 | 11.7 | 12.5 | 15.0 | 17.5 | 18.8 | 20.0 | 22.5 | 25.0 | 26.3 | 30.0 | 35.0 | 37.5 | 45.0 | 52.5 |
|---|---|---|---|---|---|---|---|---|---|---|---|---|---|---|---|---|---|---|---|---|---|---|---|---|---|---|---|---|---|---|---|---|---|---|---|---|---|---|
| 1.0 | 2.0 | 2.3 | 2.5 | 2.7 | 3.0 | 3.3 | 3.5 | 4.0 | 4.3 | 4.5 | 4.8 | 5.0 | 5.2 | 6.0 | 6.8 | 7.0 | 7.3 | 7.7 | 8.0 | 8.5 | 9.3 | 9.8 | 11.0 | 12.3 | 12.7 | 13.5 | 16.0 | 18.5 | 19.8 | 21.0 | 23.5 | 26.0 | 27.3 | 31.0 | 36.0 | 38.5 | 46.0 | 53.5 |
| 1.3 | 2.3 | 2.7 | 2.8 | 3.0 | 3.3 | 3.7 | 3.8 | 4.3 | 4.7 | 4.8 | 5.1 | 5.3 | 5.5 | 6.3 | 7.2 | 7.3 | 7.6 | 8.0 | 8.3 | 8.8 | 9.7 | 10.1 | 11.3 | 12.6 | 13.0 | 13.8 | 16.3 | 18.8 | 20.1 | 21.3 | 23.8 | 26.3 | 27.6 | 31.3 | 36.3 | 38.8 | 46.3 | 53.8 |
| 1.5 | 2.5 | 2.8 | 3.0 | 3.2 | 3.5 | 3.8 | 4.0 | 4.5 | 4.8 | 5.0 | 5.3 | 5.5 | 5.7 | 6.5 | 7.3 | 7.5 | 7.8 | 8.2 | 8.5 | 9.0 | 9.8 | 10.3 | 11.5 | 12.8 | 13.2 | 14.0 | 16.5 | 19.0 | 20.3 | 21.5 | 24.0 | 26.5 | 27.8 | 31.5 | 36.5 | 39.0 | 46.5 | 54.0 |
| 1.7 | 2.7 | 3.0 | 3.2 | 3.3 | 3.7 | 4.0 | 4.2 | 4.7 | 5.0 | 5.2 | 5.4 | 5.7 | 5.8 | 6.7 | 7.5 | 7.7 | 7.9 | 8.3 | 8.7 | 9.2 | 10.0 | 10.4 | 11.7 | 12.9 | 13.3 | 14.2 | 16.7 | 19.2 | 20.4 | 21.7 | 24.2 | 26.7 | 27.9 | 31.7 | 36.7 | 39.2 | 46.7 | 54.2 |
| 2.0 | 3.0 | 3.3 | 3.5 | 3.7 | 4.0 | 4.3 | 4.5 | 5.0 | 5.3 | 5.5 | 5.8 | 6.0 | 6.2 | 7.0 | 7.8 | 8.0 | 8.3 | 8.7 | 9.0 | 9.5 | 10.3 | 10.8 | 12.0 | 13.3 | 13.7 | 14.5 | 17.0 | 19.5 | 20.8 | 22.0 | 24.5 | 27.0 | 28.3 | 32.0 | 37.0 | 39.5 | 47.0 | 54.5 |
| 2.3 | 3.3 | 3.7 | 3.8 | 4.0 | 4.3 | 4.7 | 4.8 | 5.3 | 5.7 | 5.8 | 6.1 | 6.3 | 6.5 | 7.3 | 8.2 | 8.3 | 8.6 | 9.0 | 9.3 | 9.8 | 10.7 | 11.1 | 12.3 | 13.6 | 14.0 | 14.8 | 17.3 | 19.8 | 21.1 | 22.3 | 24.8 | 27.3 | 28.6 | 32.3 | 37.3 | 39.8 | 47.3 | 54.8 |
| 2.5 | 3.5 | 3.8 | 4.0 | 4.2 | 4.5 | 4.8 | 5.0 | 5.5 | 5.8 | 6.0 | 6.3 | 6.5 | 6.7 | 7.5 | 8.3 | 8.5 | 8.8 | 9.2 | 9.5 | 10.0 | 10.8 | 11.3 | 12.5 | 13.8 | 14.2 | 15.0 | 17.5 | 20.0 | 21.3 | 22.5 | 25.0 | 27.5 | 28.8 | 32.5 | 37.5 | 40.0 | 47.5 | 55.0 |
| 3.0 | 4.0 | 4.3 | 4.5 | 4.7 | 5.0 | 5.3 | 5.5 | 6.0 | 6.3 | 6.5 | 6.8 | 7.0 | 7.2 | 8.0 | 8.8 | 9.0 | 9.3 | 9.7 | 10.0 | 10.5 | 11.3 | 11.8 | 13.0 | 14.3 | 14.7 | 15.5 | 18.0 | 20.5 | 21.8 | 23.0 | 25.5 | 28.0 | 29.3 | 33.0 | 38.0 | 40.5 | 48.0 | 55.5 |
| 3.3 | 4.3 | 4.7 | 4.8 | 5.0 | 5.3 | 5.7 | 5.8 | 6.3 | 6.7 | 6.8 | 7.1 | 7.3 | 7.5 | 8.3 | 9.2 | 9.3 | 9.6 | 10.0 | 10.3 | 10.8 | 11.7 | 12.1 | 13.3 | 14.6 | 15.0 | 15.8 | 18.3 | 20.8 | 22.1 | 23.3 | 25.8 | 28.3 | 29.6 | 33.3 | 38.3 | 40.8 | 48.3 | 55.8 |
| 3.5 | 4.5 | 4.8 | 5.0 | 5.2 | 5.5 | 5.8 | 6.0 | 6.5 | 6.8 | 7.0 | 7.3 | 7.5 | 7.7 | 8.5 | 9.3 | 9.5 | 9.8 | 10.2 | 10.5 | 11.0 | 11.8 | 12.3 | 13.5 | 14.8 | 15.2 | 16.0 | 18.5 | 21.0 | 22.3 | 23.5 | 26.0 | 28.5 | 29.8 | 33.5 | 38.5 | 41.0 | 48.5 | 56.0 |
| 3.8 | 4.8 | 5.1 | 5.3 | 5.4 | 5.8 | 6.1 | 6.3 | 6.8 | 7.1 | 7.3 | 7.5 | 7.8 | 7.9 | 8.8 | 9.6 | 9.8 | 10.0 | 10.4 | 10.8 | 11.3 | 12.1 | 12.5 | 13.8 | 15.0 | 15.4 | 16.3 | 18.8 | 21.3 | 22.5 | 23.8 | 26.3 | 28.8 | 30.0 | 33.8 | 38.8 | 41.3 | 48.8 | 56.3 |
| 4.0 | 5.0 | 5.3 | 5.5 | 5.7 | 6.0 | 6.3 | 6.5 | 7.0 | 7.3 | 7.5 | 7.8 | 8.0 | 8.2 | 9.0 | 9.8 | 10.0 | 10.3 | 10.7 | 11.0 | 11.5 | 12.3 | 12.8 | 14.0 | 15.3 | 15.7 | 16.5 | 19.0 | 21.5 | 22.8 | 24.0 | 26.5 | 29.0 | 30.3 | 34.0 | 39.0 | 41.5 | 49.0 | 56.5 |
| 4.2 | 5.2 | 5.5 | 5.7 | 5.8 | 6.2 | 6.5 | 6.7 | 7.2 | 7.5 | 7.7 | 7.9 | 8.2 | 8.3 | 9.2 | 10.0 | 10.2 | 10.4 | 10.8 | 11.2 | 11.7 | 12.5 | 12.9 | 14.2 | 15.4 | 15.8 | 16.7 | 19.2 | 21.7 | 22.9 | 24.2 | 26.7 | 29.2 | 30.4 | 34.2 | 39.2 | 41.7 | 49.2 | 56.7 |
| 5.0 | 6.0 | 6.3 | 6.5 | 6.7 | 7.0 | 7.3 | 7.5 | 8.0 | 8.3 | 8.5 | 8.8 | 9.0 | 9.2 | 10.0 | 10.8 | 11.0 | 11.3 | 11.7 | 12.0 | 12.5 | 13.3 | 13.8 | 15.0 | 16.3 | 16.7 | 17.5 | 20.0 | 22.5 | 23.8 | 25.0 | 27.5 | 30.0 | 31.3 | 35.0 | 40.0 | 42.5 | 50.0 | 57.5 |
| 5.8 | 6.8 | 7.2 | 7.3 | 7.5 | 7.8 | 8.2 | 8.3 | 8.8 | 9.2 | 9.3 | 9.6 | 9.8 | 10.0 | 10.8 | 11.7 | 11.8 | 12.1 | 12.5 | 12.8 | 13.3 | 14.2 | 14.6 | 15.8 | 17.1 | 17.5 | 18.3 | 20.8 | 23.3 | 24.6 | 25.8 | 28.3 | 30.8 | 32.1 | 35.8 | 40.8 | 43.3 | 50.8 | 58.3 |
| 6.0 | 7.0 | 7.3 | 7.5 | 7.7 | 8.0 | 8.3 | 8.5 | 9.0 | 9.3 | 9.5 | 9.8 | 10.0 | 10.2 | 11.0 | 11.8 | 12.0 | 12.3 | 12.7 | 13.0 | 13.5 | 14.3 | 14.8 | 16.0 | 17.3 | 17.7 | 18.5 | 21.0 | 23.5 | 24.8 | 26.0 | 28.5 | 31.0 | 32.3 | 36.0 | 41.0 | 43.5 | 51.0 | 58.5 |
| 6.3 | 7.3 | 7.6 | 7.8 | 7.9 | 8.3 | 8.6 | 8.8 | 9.3 | 9.6 | 9.8 | 10.0 | 10.3 | 10.4 | 11.3 | 12.1 | 12.3 | 12.5 | 12.9 | 13.3 | 13.8 | 14.6 | 15.0 | 16.3 | 17.5 | 17.9 | 18.8 | 21.3 | 23.8 | 25.0 | 26.3 | 28.8 | 31.3 | 32.5 | 36.3 | 41.3 | 43.8 | 51.3 | 58.8 |
| 6.7 | 7.7 | 8.0 | 8.2 | 8.3 | 8.7 | 9.0 | 9.2 | 9.7 | 10.0 | 10.2 | 10.4 | 10.7 | 10.8 | 11.7 | 12.5 | 12.7 | 12.9 | 13.3 | 13.7 | 14.2 | 15.0 | 15.4 | 16.7 | 17.9 | 18.3 | 19.2 | 21.7 | 24.2 | 25.4 | 26.7 | 29.2 | 31.7 | 32.9 | 36.7 | 41.7 | 44.2 | 51.7 | 59.2 |
| 7.0 | 8.0 | 8.3 | 8.5 | 8.7 | 9.0 | 9.3 | 9.5 | 10.0 | 10.3 | 10.5 | 10.8 | 11.0 | 11.2 | 12.0 | 12.8 | 13.0 | 13.3 | 13.7 | 14.0 | 14.5 | 15.3 | 15.8 | 17.0 | 18.3 | 18.7 | 19.5 | 22.0 | 24.5 | 25.8 | 27.0 | 29.5 | 32.0 | 33.3 | 37.0 | 42.0 | 44.5 | 52.0 | 59.5 |
| 7.5 | 8.5 | 8.8 | 9.0 | 9.2 | 9.5 | 9.8 | 10.0 | 10.5 | 10.8 | 11.0 | 11.3 | 11.5 | 11.7 | 12.5 | 13.3 | 13.5 | 13.8 | 14.2 | 14.5 | 15.0 | 15.8 | 16.3 | 17.5 | 18.8 | 19.2 | 20.0 | 22.5 | 25.0 | 26.3 | 27.5 | 30.0 | 32.5 | 33.8 | 37.5 | 42.5 | 45.0 | 52.5 | 60.0 |
| 8.3 | 9.3 | 9.7 | 9.8 | 10.0 | 10.3 | 10.7 | 10.8 | 11.3 | 11.7 | 11.8 | 12.1 | 12.3 | 12.5 | 13.3 | 14.2 | 14.3 | 14.6 | 15.0 | 15.3 | 15.8 | 16.7 | 17.1 | 18.3 | 19.6 | 20.0 | 20.8 | 23.3 | 25.8 | 27.1 | 28.3 | 30.8 | 33.3 | 34.6 | 38.3 | 43.3 | 45.8 | 53.3 | 60.8 |
| 8.8 | 9.8 | 10.1 | 10.3 | 10.4 | 10.8 | 11.1 | 11.3 | 11.8 | 12.1 | 12.3 | 12.5 | 12.8 | 12.9 | 13.8 | 14.6 | 14.8 | 15.0 | 15.4 | 15.8 | 16.3 | 17.1 | 17.5 | 18.8 | 20.0 | 20.4 | 21.3 | 23.8 | 26.3 | 27.5 | 28.8 | 31.3 | 33.8 | 35.0 | 38.8 | 43.8 | 46.3 | 53.8 | 61.3 |
| 10.0 | 11.0 | 11.3 | 11.5 | 11.7 | 12.0 | 12.3 | 12.5 | 13.0 | 13.3 | 13.5 | 13.8 | 14.0 | 14.2 | 15.0 | 15.8 | 16.0 | 16.3 | 16.7 | 17.0 | 17.5 | 18.3 | 18.8 | 20.0 | 21.3 | 21.7 | 22.5 | 25.0 | 27.5 | 28.8 | 30.0 | 32.5 | 35.0 | 36.3 | 40.0 | 45.0 | 47.5 | 55.0 | 62.5 |
| 11.3 | 12.3 | 12.6 | 12.8 | 12.9 | 13.3 | 13.6 | 13.8 | 14.3 | 14.6 | 14.8 | 15.0 | 15.3 | 15.4 | 16.3 | 17.1 | 17.3 | 17.5 | 17.9 | 18.3 | 18.8 | 19.6 | 20.0 | 21.3 | 22.5 | 22.9 | 23.8 | 26.3 | 28.8 | 30.0 | 31.3 | 33.8 | 36.3 | 37.5 | 41.3 | 46.3 | 48.8 | 56.3 | 63.8 |
| 11.7 | 12.7 | 13.0 | 13.2 | 13.3 | 13.7 | 14.0 | 14.2 | 14.7 | 15.0 | 15.2 | 15.4 | 15.7 | 15.8 | 16.7 | 17.5 | 17.7 | 17.9 | 18.3 | 18.7 | 19.2 | 20.0 | 20.4 | 21.7 | 22.9 | 23.3 | 24.2 | 26.7 | 29.2 | 30.4 | 31.7 | 34.2 | 36.7 | 37.9 | 41.7 | 46.7 | 49.2 | 56.7 | 64.2 |
| 12.5 | 13.5 | 13.8 | 14.0 | 14.2 | 14.5 | 14.8 | 15.0 | 15.5 | 15.8 | 16.0 | 16.3 | 16.5 | 16.7 | 17.5 | 18.3 | 18.5 | 18.8 | 19.2 | 19.5 | 20.0 | 20.8 | 21.3 | 22.5 | 23.8 | 24.2 | 25.0 | 27.5 | 30.0 | 31.3 | 32.5 | 35.0 | 37.5 | 38.8 | 42.5 | 47.5 | 50.0 | 57.5 | 65.0 |
| 15.0 | 16.0 | 16.3 | 16.5 | 16.7 | 17.0 | 17.3 | 17.5 | 18.0 | 18.3 | 18.5 | 18.8 | 19.0 | 19.2 | 20.0 | 20.8 | 21.0 | 21.3 | 21.7 | 22.0 | 22.5 | 23.3 | 23.8 | 25.0 | 26.3 | 26.7 | 27.5 | 30.0 | 32.5 | 33.8 | 35.0 | 37.5 | 40.0 | 41.3 | 45.0 | 50.0 | 52.5 | 60.0 | 67.5 |
| 17.5 | 18.5 | 18.8 | 19.0 | 19.2 | 19.5 | 19.8 | 20.0 | 20.5 | 20.8 | 21.0 | 21.3 | 21.5 | 21.7 | 22.5 | 23.3 | 23.5 | 23.8 | 24.2 | 24.5 | 25.0 | 25.8 | 26.3 | 27.5 | 28.8 | 29.2 | 30.0 | 32.5 | 35.0 | 36.3 | 37.5 | 40.0 | 42.5 | 43.8 | 47.5 | 52.5 | 55.0 | 62.5 | 70.0 |
| 18.8 | 19.8 | 20.1 | 20.3 | 20.4 | 20.8 | 21.1 | 21.3 | 21.8 | 22.1 | 22.3 | 22.5 | 22.8 | 22.9 | 23.8 | 24.6 | 24.8 | 25.0 | 25.4 | 25.8 | 26.3 | 27.1 | 27.5 | 28.8 | 30.0 | 30.4 | 31.3 | 33.8 | 36.3 | 37.5 | 38.8 | 41.3 | 43.8 | 45.0 | 48.8 | 53.8 | 56.3 | 63.8 | 71.3 |
| 20.0 | 21.0 | 21.3 | 21.5 | 21.7 | 22.0 | 22.3 | 22.5 | 23.0 | 23.3 | 23.5 | 23.8 | 24.0 | 24.2 | 25.0 | 25.8 | 26.0 | 26.3 | 26.7 | 27.0 | 27.5 | 28.3 | 28.8 | 30.0 | 31.3 | 31.7 | 32.5 | 35.0 | 37.5 | 38.8 | 40.0 | 42.5 | 45.0 | 46.3 | 50.0 | 55.0 | 57.5 | 65.0 | 72.5 |
| 22.5 | 23.5 | 23.8 | 24.0 | 24.2 | 24.5 | 24.8 | 25.0 | 25.5 | 25.8 | 26.0 | 26.3 | 26.5 | 26.7 | 27.5 | 28.3 | 28.5 | 28.8 | 29.2 | 29.5 | 30.0 | 30.8 | 31.3 | 32.5 | 33.8 | 34.2 | 35.0 | 37.5 | 40.0 | 41.3 | 42.5 | 45.0 | 47.5 | 48.8 | 52.5 | 57.5 | 60.0 | 67.5 | 75.0 |
| 25.0 | 26.0 | 26.3 | 26.5 | 26.7 | 27.0 | 27.3 | 27.5 | 28.0 | 28.3 | 28.5 | 28.8 | 29.0 | 29.2 | 30.0 | 30.8 | 31.0 | 31.3 | 31.7 | 32.0 | 32.5 | 33.3 | 33.8 | 35.0 | 36.3 | 36.7 | 37.5 | 40.0 | 42.5 | 43.8 | 45.0 | 47.5 | 50.0 | 51.3 | 55.0 | 60.0 | 62.5 | 70.0 | 77.5 |
| 26.3 | 27.3 | 27.6 | 27.8 | 27.9 | 28.3 | 28.6 | 28.8 | 29.3 | 29.6 | 29.8 | 30.0 | 30.3 | 30.4 | 31.3 | 32.1 | 32.3 | 32.5 | 32.9 | 33.3 | 33.8 | 34.6 | 35.0 | 36.3 | 37.5 | 37.9 | 38.8 | 41.3 | 43.8 | 45.0 | 46.3 | 48.8 | 51.3 | 52.5 | 56.3 | 61.3 | 63.8 | 71.3 | 78.8 |
| 30.0 | 31.0 | 31.3 | 31.5 | 31.7 | 32.0 | 32.3 | 32.5 | 33.0 | 33.3 | 33.5 | 33.8 | 34.0 | 34.2 | 35.0 | 35.8 | 36.0 | 36.3 | 36.7 | 37.0 | 37.5 | 38.3 | 38.8 | 40.0 | 41.3 | 41.7 | 42.5 | 45.0 | 47.5 | 48.8 | 50.0 | 52.5 | 55.0 | 56.3 | 60.0 | 65.0 | 67.5 | 75.0 | 82.5 |
| 35.0 | 36.0 | 36.3 | 36.5 | 36.7 | 37.0 | 37.3 | 37.5 | 38.0 | 38.3 | 38.5 | 38.8 | 39.0 | 39.2 | 40.0 | 40.8 | 41.0 | 41.3 | 41.7 | 42.0 | 42.5 | 43.3 | 43.8 | 45.0 | 46.3 | 46.7 | 47.5 | 50.0 | 52.5 | 53.8 | 55.0 | 57.5 | 60.0 | 61.3 | 65.0 | 70.0 | 72.5 | 80.0 | 87.5 |
| 37.5 | 38.5 | 38.8 | 39.0 | 39.2 | 39.5 | 39.8 | 40.0 | 40.5 | 40.8 | 41.0 | 41.3 | 41.5 | 41.7 | 42.5 | 43.3 | 43.5 | 43.8 | 44.2 | 44.5 | 45.0 | 45.8 | 46.3 | 47.5 | 48.8 | 49.2 | 50.0 | 52.5 | 55.0 | 56.3 | 57.5 | 60.0 | 62.5 | 63.8 | 67.5 | 72.5 | 75.0 | 82.5 | 90.0 |
| 45.0 | 46.0 | 46.3 | 46.5 | 46.7 | 47.0 | 47.3 | 47.5 | 48.0 | 48.3 | 48.5 | 48.8 | 49.0 | 49.2 | 50.0 | 50.8 | 51.0 | 51.3 | 51.7 | 52.0 | 52.5 | 53.3 | 53.8 | 55.0 | 56.3 | 56.7 | 57.5 | 60.0 | 62.5 | 63.8 | 65.0 | 67.5 | 70.0 | 71.3 | 75.0 | 80.0 | 82.5 | 90.0 | 97.5 |
| 52.5 | 53.5 | 53.8 | 54.0 | 54.2 | 54.5 | 54.8 | 55.0 | 55.5 | 55.8 | 56.0 | 56.3 | 56.5 | 56.7 | 57.5 | 58.3 | 58.5 | 58.8 | 59.2 | 59.5 | 60.0 | 60.8 | 61.3 | 62.5 | 63.8 | 64.2 | 65.0 | 67.5 | 70.0 | 71.3 | 72.5 | 75.0 | 77.5 | 78.8 | 82.5 | 87.5 | 90.0 | 97.5 | 105.0 |

*Fig. 7*

Upstream Side Supply Roller Index A2

| Downstream Side Supply Roller Index A1 | 1.0 | 1.3 | 1.5 | 1.7 | 2.0 | 2.3 | 2.5 | 3.0 | 3.3 | 3.5 | 3.8 | 4.0 | 4.2 | 5.0 | 5.8 | 6.0 | 6.3 | 6.7 | 7.0 | 7.5 | 8.3 | 8.8 | 10.0 | 11.3 | 11.7 | 12.5 | 15.0 | 17.5 | 18.8 | 20.0 | 22.5 | 25.0 | 26.3 | 30.0 | 35.0 | 37.5 | 45.0 | 52.5 |
|---|---|---|---|---|---|---|---|---|---|---|---|---|---|---|---|---|---|---|---|---|---|---|---|---|---|---|---|---|---|---|---|---|---|---|---|---|---|---|
| 1.0 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 1 |
| 1.3 | 1 | 1 | 1 | 1 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 1 |
| 1.5 | 1 | 1 | 1 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 1 |
| 1.7 | 1 | 1 | 1 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 1 |
| 2.0 | 1 | 1 | 1 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 1 |
| 2.3 | 1 | 1 | 1 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 1 |
| 2.5 | 1 | 1 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 2 | 1 |
| 3.0 | 1 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 2 | 2 | 1 |
| 3.3 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 2 | 2 | 2 | 1 |
| 3.5 | 1 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 2 | 2 | 2 | 1 |
| 3.8 | 1 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 2 | 2 | 2 | 2 | 1 |
| 4.0 | 1 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 1 |
| 4.2 | 1 | 1 | 1 | 1 | 1 | 1 | 1 | 1 | 1 | 1 | 1 | 1 | 1 | 1 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 1 |
| 5.0 | 1 | 1 | 1 | 1 | 1 | 1 | 1 | 1 | 1 | 1 | 1 | 1 | 1 | 2 | 3 | 3 | 3 | 3 | 3 | 3 | 3 | 3 | 3 | 3 | 3 | 3 | 3 | 3 | 3 | 3 | 3 | 3 | 2 | 2 | 2 | 2 | 2 | 1 |
| 5.8 | 1 | 1 | 1 | 1 | 1 | 1 | 1 | 1 | 1 | 1 | 1 | 1 | 2 | 2 | 3 | 3 | 3 | 3 | 3 | 3 | 3 | 3 | 3 | 3 | 3 | 3 | 3 | 3 | 3 | 3 | 3 | 3 | 2 | 2 | 2 | 2 | 1 | 1 |
| 6.0 | 1 | 1 | 1 | 1 | 1 | 1 | 1 | 1 | 1 | 1 | 1 | 2 | 2 | 2 | 2 | 3 | 3 | 3 | 3 | 3 | 3 | 3 | 3 | 3 | 3 | 3 | 3 | 3 | 3 | 3 | 3 | 3 | 2 | 2 | 2 | 2 | 1 | 1 |
| 6.3 | 1 | 1 | 1 | 1 | 1 | 1 | 1 | 1 | 1 | 1 | 2 | 2 | 2 | 2 | 2 | 2 | 3 | 3 | 3 | 3 | 3 | 3 | 3 | 3 | 3 | 3 | 3 | 3 | 3 | 3 | 3 | 3 | 2 | 2 | 2 | 2 | 1 | 1 |
| 6.7 | 1 | 1 | 1 | 1 | 1 | 1 | 1 | 1 | 2 | 2 | 2 | 2 | 2 | 2 | 2 | 2 | 2 | 3 | 3 | 3 | 3 | 3 | 3 | 3 | 3 | 3 | 3 | 3 | 3 | 3 | 3 | 3 | 2 | 2 | 2 | 2 | 1 | 1 |
| 7.0 | 1 | 1 | 1 | 1 | 1 | 1 | 1 | 2 | 2 | 2 | 2 | 2 | 2 | 2 | 2 | 2 | 2 | 2 | 3 | 3 | 3 | 3 | 3 | 3 | 3 | 3 | 3 | 3 | 3 | 3 | 3 | 3 | 2 | 2 | 2 | 2 | 1 | 1 |
| 7.5 | 1 | 1 | 1 | 1 | 1 | 1 | 2 | 2 | 2 | 2 | 2 | 2 | 2 | 2 | 2 | 2 | 2 | 2 | 2 | 3 | 3 | 3 | 3 | 3 | 3 | 3 | 3 | 3 | 3 | 3 | 3 | 3 | 2 | 2 | 2 | 2 | 1 | 1 |
| 8.3 | 1 | 1 | 1 | 2 | 2 | 2 | 2 | 2 | 2 | 2 | 2 | 2 | 2 | 2 | 2 | 2 | 2 | 2 | 2 | 2 | 3 | 3 | 3 | 3 | 3 | 3 | 3 | 3 | 3 | 3 | 3 | 3 | 2 | 2 | 2 | 2 | 1 | 1 |
| 8.8 | 1 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 3 | 3 | 3 | 3 | 3 | 3 | 3 | 3 | 2 | 2 | 2 | 2 | 1 | 1 |
| 10.0 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 3 | 3 | 3 | 3 | 3 | 3 | 3 | 2 | 2 | 2 | 2 | 1 | 1 |
| 11.3 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 3 | 3 | 3 | 3 | 3 | 3 | 2 | 2 | 2 | 2 | 1 | 1 |
| 11.7 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 3 | 3 | 3 | 3 | 3 | 2 | 2 | 2 | 2 | 1 | 1 |
| 12.5 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 3 | 3 | 3 | 2 | 2 | 2 | 2 | 1 | 1 |
| 15.0 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 3 | 3 | 3 | 2 | 2 | 2 | 1 | 1 | 1 |
| 17.5 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 3 | 3 | 2 | 2 | 1 | 1 | 1 | 1 |
| 18.8 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 3 | 2 | 2 | 1 | 1 | 1 | 1 |
| 20.0 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 3 | 2 | 2 | 1 | 1 | 1 | 1 |
| 22.5 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 3 | 2 | 1 | 1 | 1 | 1 | 1 |
| 25.0 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 3 | 1 | 1 | 1 | 1 | 1 | 1 |
| 26.3 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 1 | 1 | 1 | 1 | 1 | 1 | 1 |
| 30.0 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 1 | 1 | 1 | 1 | 1 | 1 | 1 | 1 |
| 35.0 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 1 | 1 | 1 | 1 | 1 | 1 | 1 | 1 | 1 | 1 | 1 |
| 37.5 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 2 | 1 | 1 | 1 | 1 | 1 | 1 | 1 | 1 | 1 | 1 | 1 | 1 |
| 45.0 | 2 | 2 | 2 | 2 | 2 | 2 | 2 | 2 | 2 | 2 | 2 | 2 | 2 | 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 52.5 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |

DEVELOPMENT APPARATUS AND IMAGE FORMING APPARATUS

CROSS REFERENCE

The present application is related to, claims priority from and incorporates by reference Japanese Patent Application No. 2014-035767, filed on Feb. 26, 2014.

TECHNICAL FIELD

The present invention relates to a development apparatus and an image forming apparatus, and can be applied to, for example, an electrographic printer.

BACKGROUND

In a conventional electrographic image forming apparatus, like the apparatus described in Patent Document (Japanese Unexamined Patent Application Publication No. 10-39628), there existed an apparatus equipped with two supply rollers of the same shape as developer supply members.

However, in a conventional development apparatus equipped with two supply rollers, since two supply rollers are rotated in a state in which the rollers are in press-contact with a development roller, the external force (stress) that toner receives is large. Therefore, it was difficult to maintain desired image quality.

SUMMARY

A development apparatus disclosed in the application includes:

an electrostatic latent image carrier configured to hold an electrostatic latent image on a surface thereof while rotating; a developer carrier configured to develop the electrostatic latent image using a developer while rotating; a developer accommodation section configured to accommodate the developer; and a first and second developer supply members each configured to supply the developer accommodated in the developer accommodation section to the developer carrier while rotating. The first developer supply member and the second developer supply member are each arranged at positions opposite to the developer carrier so as to come into press-contact with the developer carrier, the first developer supply member is arranged on a downstream side of the developer carrier in a rotation direction than the second developer supply member, an elastic layer is formed on an outer peripheral surface of each of the first developer supply member and the second developer supply member, and Hs1, Δ1, t1, Hs2, Δ2, and t2 satisfy a following formula (A), $$10 \leq Hs1 \times (\Delta 1/t1) + Hs2 \times (\Delta 2/t2) \leq 50 \quad \text{(A)}$$

Herein, Hs1 is a hardness of the outer peripheral surface of the first developer supply member, t1 is a layer thickness of the elastic layer of the first developer supply member, Δ1 is an NIP amount that is determined when the first developer supply member is in press-contact with the developer carrier, Hs2 is a hardness of the outer peripheral surface of the second developer supply member, t2 is a layer thickness of the elastic layer of the second developer supply member, and Δ2 is an NIP amount that is determined when the second developer supply member is in press-contact with the developer carrier.

According to the present invention, it becomes possible to maintain predetermined image quality.

BRIEF DESCRIPTION OF THE DRAWINGS

FIG. 5 is an explanatory view showing a circumferential speed ratio of a photosensitive drum, a development roller and supply rollers constituting the development apparatus according to the embodiment.

FIG. 6 is an explanatory view showing experimental conditions when the development apparatus according to the embodiment was driven.

FIG. 7 is an explanatory view showing experimental results when the development apparatus according to the embodiment was driven.

DETAILED DESCRIPTION OF PREFERRED EMBODIMENT(S)

(A) Main Embodiment

Hereinafter, an embodiment of a development apparatus and an image forming apparatus according to the present invention will be detailed with reference to drawings. In this embodiment, an example in which the development apparatus and the image forming apparatus of the present invention are applied to a printer will be explained.

(A-1) Structure of Embodiment

Figure 2:
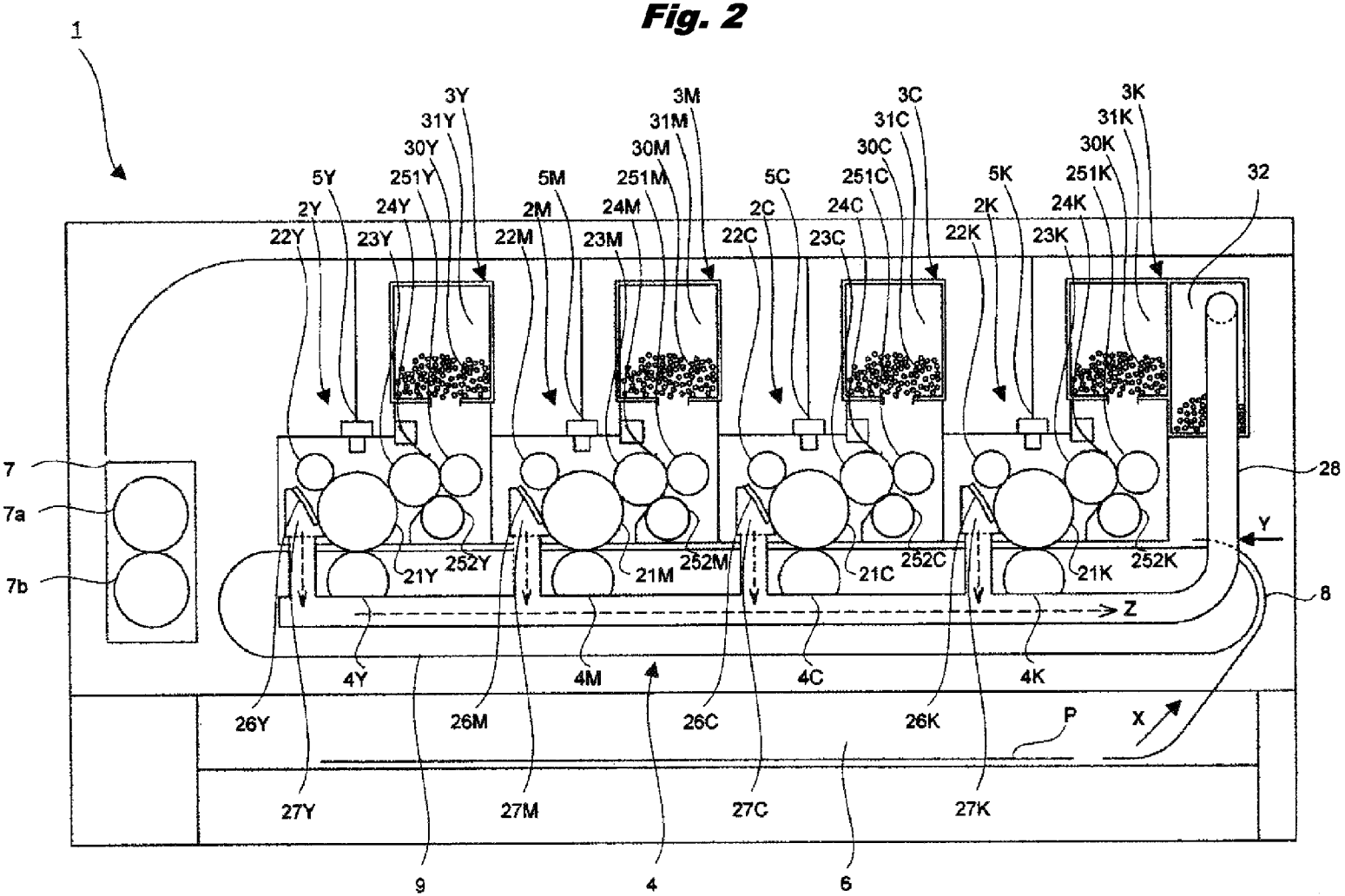
FIG. 2 is an explanatory view showing a schematic cross-sectional view of an image forming apparatus according to the embodiment.

FIG. 2 is a schematic cross-sectional view showing an entire structure of the image forming apparatus (printer) 1 according to this embodiment.

The printer 1 is provided with development apparatuses 2 (2K, 2C, 2M, 2Y) corresponding to developers (toners) 30 (30K, 30C, 30M, 30Y) of black (K), cyan (C), magenta (M), and yellow (Y), and toner cartridges 3 (3K, 3C, 3M, 3Y) as developer containers for accommodating toners 30 (30K, 30C, 30M, 30Y).

Further, the printer 1 is provided with transfer units 4 (4K, 4C, 4M, 4Y) each for transferring a toner image developed on the photosensitive drum 21 (21K, 21C, 21M, 21Y) as a electrostatic latent image carrier which will be explained to a sheet P and exposure units 5 (5K, 5C, 5M, 5Y) each for forming an electrostatic latent image by irradiating light on a surface of the photosensitive drum 21.

Further, the printer 1 is provided with a sheet feeding cassette 6 for accommodating sheets P (media) and feeding the sheets P in the direction of X in FIG. 2, a fuser unit 7 for fusing a toner image transferred to the sheet P by the transfer units 4, and a sheet carrying path 8 formed approximately in an S-shape (formed approximately in an S-shape as seen in the direction of FIG. 2) in the printer 1.

The development apparatuses 2K, 2C, 2M and 2Y are sequentially arranged along the sheet carrying path 8 in a direction (Y direction in FIG. 2) from the upstream side (sheet supply side) to the downstream side (sheet ejection side) when carrying the sheet P. Further, the development apparatuses 2K, 2C, 2M and 2Y are detachably arranged to a printer main body (chassis). The development apparatuses 2K, 2C, 2M and 2Y are different only in color of developing toner 30K, 30C, 30M and 30Y, and are the same in fundamental structure. Hereinafter, about only one development apparatus 2, the detail structure will be explained using FIG. 3.

The development apparatus 2 is provided with a photosensitive drum 21, a charge roller 22 as a charge member for evenly charging a surface of the photosensitive drum 21, and a development roller 23 as a developer carrier for developing the toner 30 on the photosensitive drum 21.

Further, the development apparatus 2 is provided with a development blade 24 for controlling a layer thickness of the toner 30 supplied to the development roller 23, and two supply rollers 251 and 252 as developer supply members for supplying the toner 30 to the development roller 23.

Further, the development apparatus 2 is further provided with a cleaning blade 26 for removing the remaining toner 30 remaining on the photosensitive drum 21 not transferred to the sheet P, and a carrying means for carrying the remaining toner 30 removed by the cleaning blade 26 as waste toner 30.

In this embodiment, for example, a photosensitive drum 21 is constituted by a conductive supporting member and a photoconductive layer, and is an organic photosensitive body structured such that a blocking layer, a charge generation layer as a photoconductive layer, and a charge transportation layer are sequentially laminated on a metal pipe of aluminum, etc., as the conductive member.

In this embodiment, for example, the charge roller 22 is constituted by a metal shaft and a semi-conductive rubber layer such as epichlorohydrin rubber, etc. Further, the charge roller 22 is in press-contact with the photosensitive drum 21 at a predetermined pressure and driven by the rotation of the photosensitive drum 21.

In this embodiment, for example, the development roller 23 is constituted such that a semi-conductive rubber layer (semi-conductive urethane rubber layer) 23*b* as a semi-conductive elastic layer (elastic layer) is formed on a surface of a shaft (metal shaft) 23*a* as a core metal. The development roller 23 is in press-contact with the photosensitive drum 21 at a predetermined pressure and rotated in the same direction (in the direction of Z1 in FIG. 3) as the rotation of the photosensitive drum 21 at a predetermined circumferential speed ratio.

In this embodiment, for example, the development blade 24 is constituted by a metal thin plate member having a thickness of 0.08 mm and a length which is approximately the same length as a length of the development roller 23 in the longitudinal direction and controlling a layer thickness of the toner 30. The development blade 24 is arranged such that one end thereof in the longitudinal direction is fixed to a frame (chassis of the printer main body) which is not illustrated and an inner side surface of the other end thereof positioned slightly inner than the tip end portion is in press-contact with the development roller 23.

In this embodiment, for example, the supply roller 251 and 252 is constituted such that a conductive foamed layer (for example, semi-conductive foamed silicone sponge layer) 251*b* and 252*b* is formed on a surface of a shaft (e.g., a metal shaft) 251*a* and 252*a* as a core metal. The supply rollers 251 and 252 are each in press-contact with the development roller 23 at a predetermined pressure and rotated in the counter direction (the directions Z2 and Z3 in FIG. 3) with respect to the rotation direction (the direction Z1 in FIG. 3) of the development roller 23 at a predetermined circumferential speed ratio.

Figure 1:
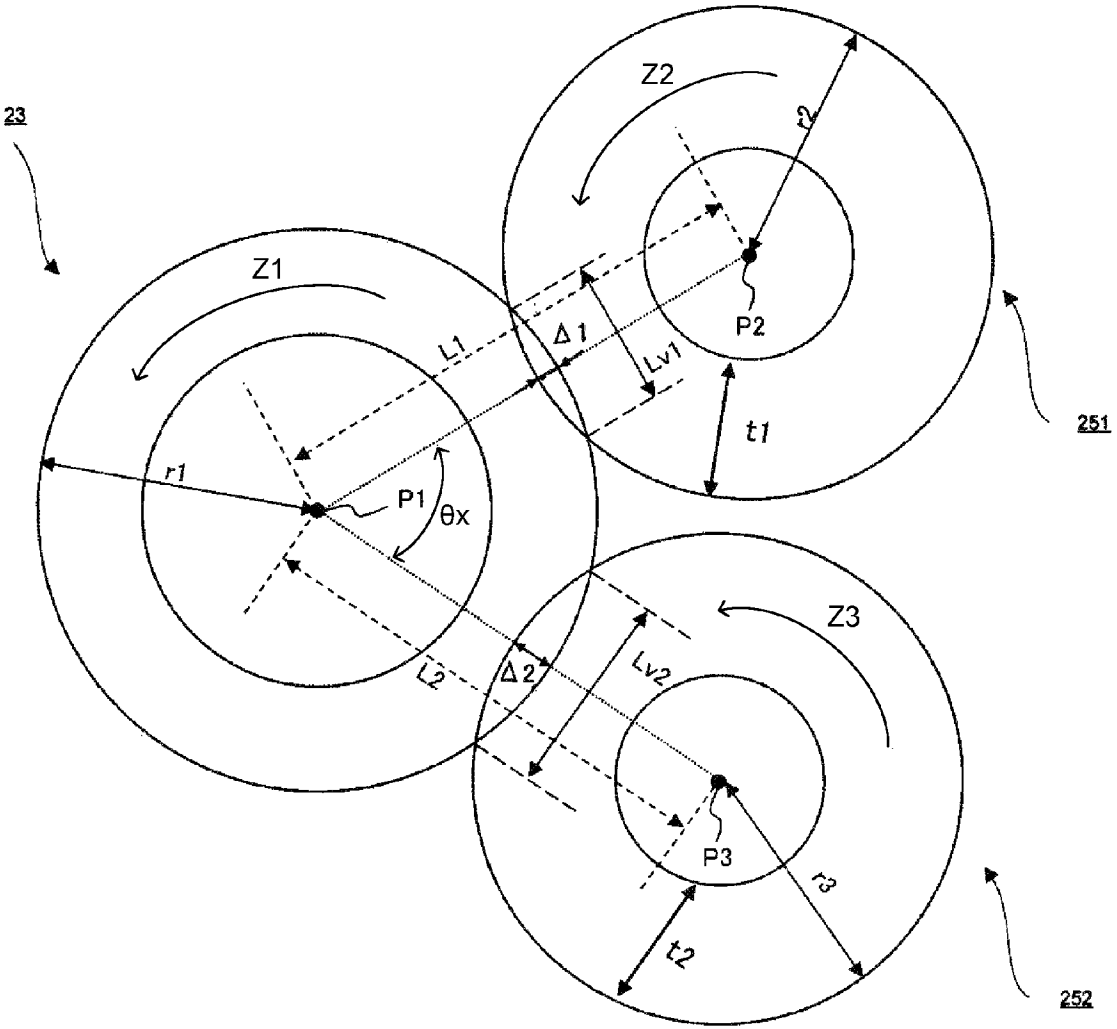
FIG. 1 is an explanatory view showing a relationship between a development roller and supply rollers according to an embodiment.

Hereinafter, the press-contact amount (width) of the supply roller 251 and 252 and the development roller 23 will be referred to as "NIP amount." In other words, the NIP amount denotes a degree of press-contact and press fitting of the development roller 23 and the supply roller 251 and 252 as shown in FIG. 1.

The cleaning blade 26 is arranged at a position where one end of the blade is in contact with the photosensitive drum 21 with a predetermined contact amount, and is constituted by urethane rubber.

The carrying means 27 is configured to carry the remaining toner 30 and adhered substances removed by the cleaning blade 26 as waste toner 30 toward a front side of the photosensitive drum 21 in the rotation axis direction. The toner 30 carried by the carrying means 27 passes the carrying path (not illustrated) for the waste toner 30 and is collected by a waste toner collection section (not illustrated).

The toner supply port 253 is an aperture (hole) for supplying the toner 30 from the toner cartridge 3 to a toner accommodation section in the development apparatus 2.

A toner stirring mechanism 254 is a rotation member formed into a spiral shape in the longitudinal direction.

A toner receiving part 255 is configured to receive a part of the toner 30 supplied from the toner supply port 253.

The development apparatus 2 and the toner cartridge 3 explained above are all replaceable parts (replacement units) in the printer 1. Therefore, the development apparatus 2 and the toner cartridge 3 can be replaceable in cases where the accommodated toner 30 is consumed, the structural member is deteriorated, etc.

The transfer unit 4 is configured such that a transfer belt 9 for transferring the sheet P while electrostatically absorbing the sheet, a drive roller, which is not illustrated, rotatably driven by a drive part, which is not illustrated, to drive the transfer belt 9, and a tension roller, which is not illustrated, for tensioning the transfer belt 9 together with the drive roller are arranged so as to face and come into contact with the photosensitive drum 21K, 21C, 21M, 21Y. Further, the transfer unit 4 is provided with a transfer roller 4K, 4C, 4M, 4Y to which a voltage is applied so as to transfer a toner image to the sheet P.

The exposure unit 5K, 5C, 5M, 5Y is an LED head equipped with light emitting elements such as LEDs (Light Emitting Diodes), etc., and a lens array.

The sheet feeding cassette 6 is detachably mounted to a lower part of the printer in a state in which sheets P are accommodated therein in a stacked manner. Above the sheet feeding cassette 6, a sheet feeding part, which is not illustrated, equipped with a hopping roller, etc., for feeding the sheets P one by one.

A fuser unit 7 is arranged on the downstream side (downstream side in the sheet carrying direction) of the sheet carrying path 8, and provided with a heat application roller 7*a*, a pressure application roller 7*b*, a thermistor not illustrated and a heat application heater not illustrated. The heat application roller 7*a* is formed by, for example, covering a heat resistance elastic layer of silicone rubber on a hollow cylindrical core metal of aluminum, etc., and further covering a PFA (tetrafluoroethylene-perfluoro alkyl-vinyl ether copolymer) tube thereon. In the core metal, for example, a heat application heater such as, e.g., a halogen lamp is provided. The pressure application roller 7*b* is structured such that a heat resistance elastic layer of silicone rubber is covered on a core metal of aluminum, etc., and a PFA tube is further covered on the elastic layer, and is arranged so as to form a contact-pressure part between the pressure application roller and the heat application roller 7. The thermistor is a surface temperature detection means for the heat application roller 7*a* and is arranged near the heat application roller 7*a* in a non-contact manner.

Next, the detail structure of the supply roller 251 and 252 will be explained with reference to FIG. 4.

Figure 4:
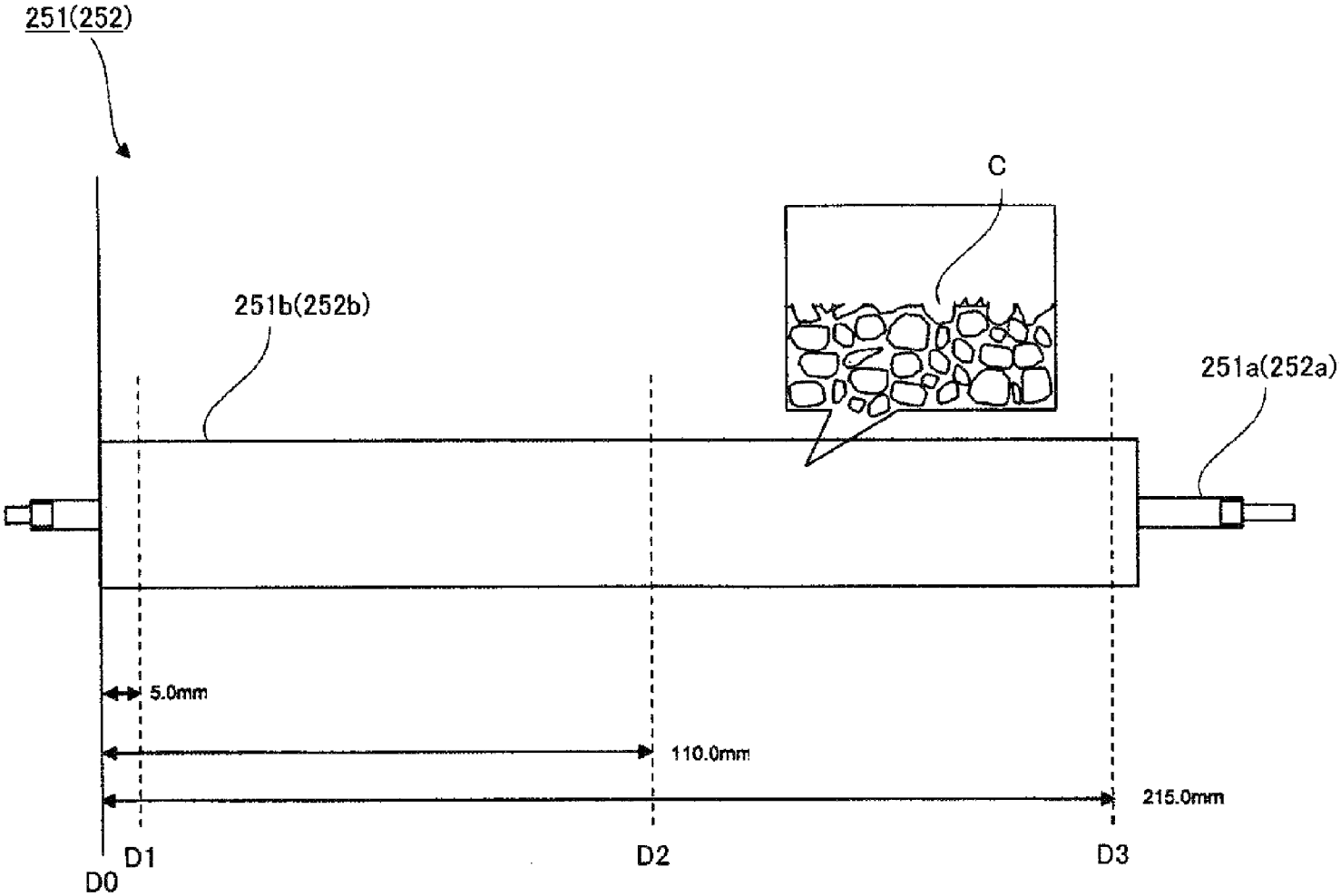
FIG. 4 is a plan view of a supply roller according to the embodiment.

FIG. 4 is a plan view of the supply roller 251 and 252.

In this embodiment, for example, the explanation will be made assuming that the supply rollers 251 and 252 are the same in shape and structure.

In this embodiment, in the supply roller 251 and 252, a conductive foamed layer 251*b* and 252*b* is formed around the shaft 251*a* and 252*a*. In the conductive foamed layer 251*b* and 252*b*, numerous cells C exist.

As a material of the conductive foamed layer 251*b* and 252*b*, for example, a rubber material such as silicone rubber, silicone-modified rubber, natural rubber, nitrile rubber, ethylene propylene rubber, ethylene-propylene rubber (EPDM), styrene-butadiene rubber, acrylonitrile-butadiene rubber, butadiene rubber, isoprene rubber, acrylic rubber, chloroprene rubber, butyl rubber, epichlorohydrin rubber, urethane rubber, fluorine rubber, or polyether rubber, or elastomers such as polyurethane, polystyrene, polybutadiene block polymer, polyolefin, polyethylene, chlorinated polyethylene, or ethylene-vinyl acetate copolymer, can be applied. As a material of the conductive foamed layer 251*b* and 252*b*, it is possible to use one type or two or more types of mixed rubber or modified rubber. Further, as a material of the conductive foamed layer 251*b* and 252*b*, it is possible to arbitrarily select a millable type or liquid type material, and especially preferably select a millable type material.

The shaft 251*a* and 252*a* can be made of metal having predetermined rigidity and sufficient conductivity, and as the metal, for example, iron, copper, brass, stainless steel, aluminum, nickel, etc., can be used. Further, even in the case of materials other than metal, any material having conductivity and appropriate rigidity can be used. As the shaft 251*a* and 252*a*, for example, it is possible to use a resin molded article in which conductive particles are dispersed, ceramics, etc. The shaft 251*a* and 252*a* can be a hollow pipe shape other than a roll shape. Further, at both ends of the shaft 251*a* and 252*a*, a gear mounting step or a pin hole can be formed. Further, at both ends of the shaft 251*a* and 252*a*, a part (tip bearing part) for linking to a driving source (motor) is formed normally. Therefore, both the end portions are formed to be smaller in outer diameter than the portion where the conductive foamed layer 251*b* and 252*b* is formed.

As a manufacturing method of the supply roller 251 and 252, for example, a method can be applied, in which a reinforcing filler, a vulcanizing agent and a foaming agent required for vulcanization, and a conductive agent are added to the aforementioned rubber material, and are sufficiently kneaded with a pressure kneader, a mixing roll, etc., then extruded in an un-vulcanized manner onto the shaft 251*a* and 252*a* to obtain a rubber pound and heated to perform vulcanization foaming. Further, the supply roller 25 can be formed by extruding the rubber pound preliminarily into a tube shape, heating it to perform vulcanization foaming to thereby form a sponge rubber tube, and then cover the sponge rubber tube onto the shaft 251*a* and 252*a*. At this time, as necessary, the shaft 251*a* and 252*a* and the conductive foamed layer 251*b* and 252*b* can be fixed with adhesive. Thereafter, it is required to subject the formed supply roller 25 to cutting work into a predetermined outer diameter.

In this embodiment, for example, the width of the semi-conductive rubber layer 23*b* is set to 220.00 mm. When viewed from the direction in FIG. 4, the left end of the semi-conductive rubber layer 23*b* in the width direction is denoted as D0, the point of 5.00 mm from the left end is denoted as D1, the point of 110.00 mm from the left end (intermediate point in the width direction) is denoted as D2, and the point of 215.00 mm from the left end (point of 5.00 mm from the right end) is denoted as D3. Hereinafter, the outer diameters of the supply roller 251 and 252 at the point of D1, D2, and D3 are expressed as ϕD1, ϕD2, and ϕD3, respectively.

The shape of the supply roller 251 and 252 is generally a straight shape in which ϕD1, ϕD2, and ϕD3 are the same in diameter. However, the shape can be a crown shape in which the ϕD2 portion is largest in diameter, a tapered shape, or a shape in which the ϕD2 portion is smallest in diameter.

Figure 3:
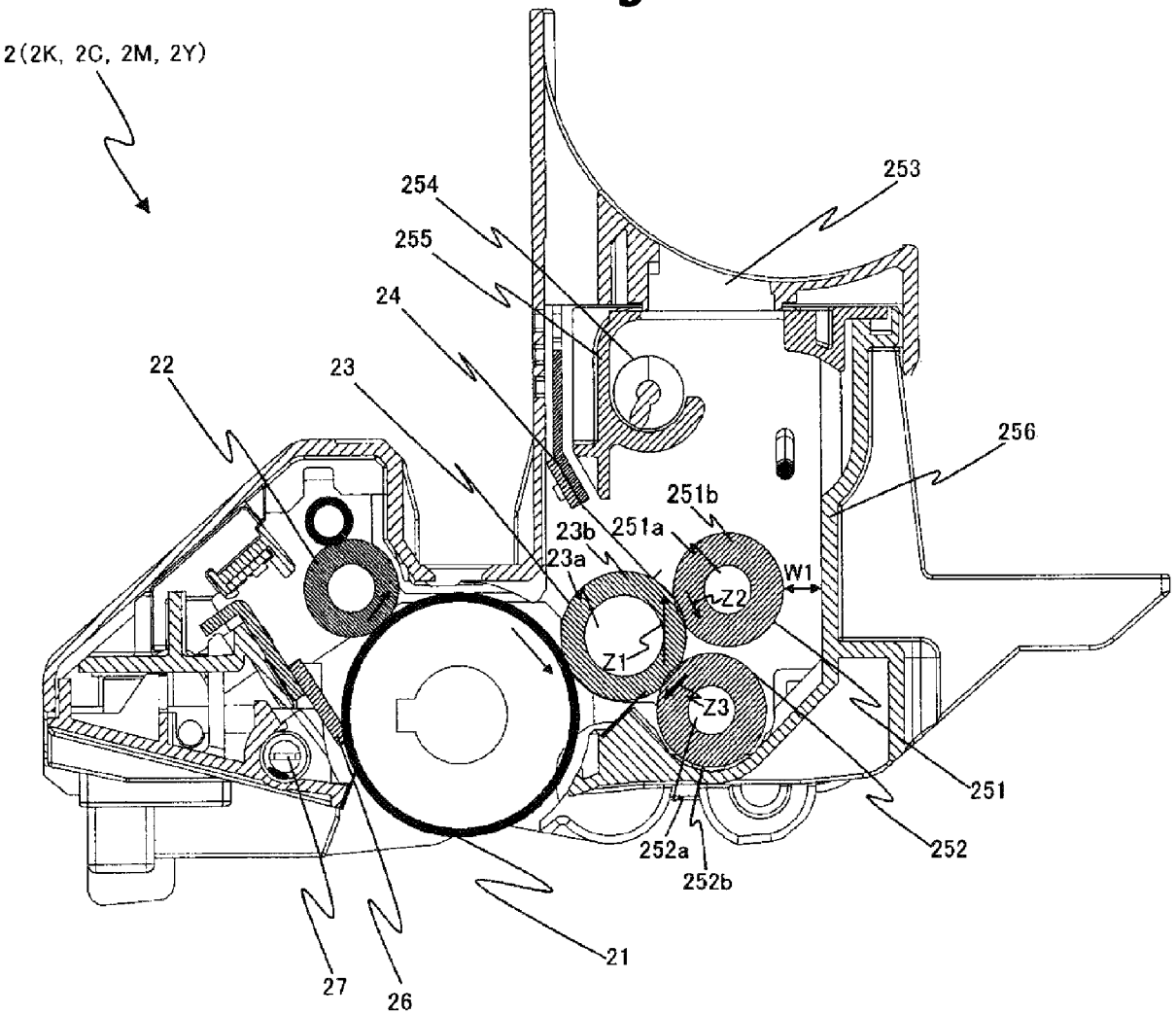
FIG. 3 is a cross-sectional view of a development apparatus according to the embodiment.

Further, in FIG. 3, the distance (shortest distance) from the outer peripheral surface of the supply roller 251 to the inner wall surface of the chassis 256 of the development apparatus 2 is denoted as w1.

Next, the detail structure of the supply roller 251 and 252 and the development roller 23 will be explained.

FIG. 1 is an explanatory view showing a relationship between the development roller 23 and the two supply rollers 251 and 252.

The NIP amount shows a degree that the development roller 23 and the supply roller 251 and 252 are press-contacted and pressed each other. In FIG. 1, the center positions of the rotation axes of the development roller 23, the supply roller 251, and the supply roller 252 are denoted as P1, P2, and P3, respectively. Further, in FIG. 1, the radii of the development roller 23, the supply roller 251, and the supply roller 252 (the width from the central position of the rotation axis to the outer peripheral surface of the semi-conductive rubber layer 23*b*) are denoted as r1, r2, and r3, respectively. Further, in FIG. 1, the width from P1 to P2 is denoted as L1, and the width from P1 to P3 is denoted as L2 in a state in which the development roller 23 and the supply roller 251 and 252 are press-contacted and pushed each other (in a press-contacted state). In FIG. 1, the NIP amount of the supply roller 251 positioned on the downstream side with respect to the rotation of the development roller 23 (rotation in the Z1 direction) is denoted as "Δ1," and the NIP amount of the supply roller 252 positioned on the upstream side with respect to the rotation of the development roller 23 (rotation of the Z1 direction) is denoted as "Δ2." The NIP amounts Δ1 and Δ2 are shown by the following formula (1) and formula (2). In the embodiment, the upstream and downstream are defined by a contact point between the development roller 23 and the photosensitive drum 21, which is shown in FIG. 3, in view of the rotational direction of the roller.

$$\Delta 1 = r1 + r2 - L1 \quad (1)$$

$$\Delta 2 = r1 + r3 - L2 \quad (2)$$

Further, in FIG. 1, the width from the contact start point where the supply rollers 251 and 252 start to contact with the development roller 23 to the contact end point where the supply rollers 251 and 252 end to contact with the development roller 23 (hereinafter referred to as "NIP width") are denoted as Lv1 and Lv2, respectively.

Further, in FIG. 1, the layer thicknesses of the conductive foamed layers 251*b* and 252*b* constituting the supply rollers 251 and 252 (width (thickness) from the inner peripheral surface of the conductive foamed layer 251*b* and 252*b* to the outer peripheral surface thereof) are denoted as t1 and t2, respectively. In the supply rollers 251 and 252, as the layer thicknesses t1 and t2 of the conductive foamed layers 251*b* and 252*b* increase, the conductive foamed layers 251*b* and 252*b* tend to be easily deformed accordingly. Therefore, the NIP amounts Δ1 and Δ2 increase even by the same pressure (pressing force).

Further, hereinafter, the hardness (AskerF hardness) of the outer peripheral surfaces of the supply rollers 251 and 252 (outer peripheral surfaces of the conductive foamed layers 251*b* and 252*b*) are denoted as Hs1 and Hs2, respectively. In the supply rollers 251 and 252, as the hardness Hs1 and Hs2 of the conductive foamed layers 251*b* and 252*b* decrease, the conductive foamed layers 251*b* and 252*b* become easily deformed accordingly. Therefore, the NIP amounts Δ1 and Δ2 increase even by the same pressure (pressing force).

The downstream side supply roller 251 and the upstream side supply roller 252 rotate while contacting with the toner 30 from the toner cartridge 3 and the development roller 23, and therefore perform to supply the toner 30 to the development roller 23 by electrically-charging the toner 30 by friction while scraping the toner 30 on the contact portion contacting with the development roller 23. In the development apparatus 2, the downstream side supply roller 251 mainly performs a function of supplying the toner 30 to the development roller 23. On the other hand, the upstream side supply roller 252 performs a function of scraping the toner 30 mainly remained on the development roller 23 after development.

As explained above, in each region of the development roller 23, the toner 30 is scraped and supplied twice by the downstream side supply roller 251 and the upstream side supply roller 252. For this reason, the defect of the upstream side supply roller 252 (insufficient scraping or excessive supplying of the toner 30) can be corrected to some degree by the downstream side supply roller 251.

As explained above, the amount or state (the damage state, electrostatic charge state, etc.) of the toner to be supplied to the development roller 23 becomes the state depending on the value or balance of the NIP amounts Δ1 and Δ2, the layer thicknesses t1 and t2, and the hardness Hs1 and Hs2 of the supply rollers 251 and 252. In other words, in the development roller 23, the amount or balance of the NIP amounts Δ1 and Δ2, the layer thicknesses t1 and t2, and the hardness Hs1 and Hs2 of the supply rollers 251 and 252 influence the quality (quality of the image forming) of the development processing.

Further, as mentioned above, between the downstream side supply roller 251 and the upstream side supply roller 252, the main function differs due to the positional relationship. Therefore, in the development apparatus 2, it is preferable that the NIP amounts Δ1 and Δ2, the layer thicknesses t1 and t2, and the hardness Hs1 and Hs2 of the supply rollers 251 and 252 are set depending on the value or balance according to the main function or the wear degree due to the positional relationship thereof.

Hereinafter, the adjustment method of the NIP amounts Δ1 and Δ2, the layer thicknesses t1 and t2, and the hardness Hs1 and Hs2 of the supply rollers 251 and 252 will be explained.

Hereinafter, in the supply rollers 251 and 252, the ratio of the layer thickness of the conductive foamed layer 251*b* and 252*b* and the NIP amount Δ1 and Δ2 will be referred to as a "press-contact ratio." The press-contact ratios B1 and B2 of the supply rollers 251 and 252 can be expressed by the following formulas, respectively.

$$B1=\Delta 1/t1 \quad (3)$$

$$B2=\Delta 2/t2 \quad (4)$$

Further, hereinafter, in the supply rollers 251 and 252, the value (design value) obtained by multiplying the press-contact ratio B1 and B2 by the hardness Hs1 and Hs2 will be referred to as a "press-contact force." The press-contact forces A1 and A2 of the supply rollers 251 and 252 can be expressed by the following formulas (5) and (6).

$$A1=Hs1\times B1=Hs1\times(\Delta 1/t1) \quad (5)$$

$$A2=Hs2\times B2=Hs2\times(\Delta 2/t2) \quad (6)$$

As the press-contact force A1 and A2 becomes smaller, the performance of supplying/scraping the toner of the supply roller 251 and 252 deteriorates and the stress to the toner also decreases. To the contrary, as the press-contact force A1 and A2 becomes larger, the performance of supplying/scraping the toner of the supply roller 251 and 252 enhances and the stress to the toner increases.

Therefore, in the printer 1, depending on the press-contact force A1 and A2 of the supply roller 251 and 252, the supply amount of the toner 30 to the development roller 23 becomes insufficient, which causes blurring (blurring of printing due to insufficient supply of the toner 30) at the time of printing and/or contamination (contamination due to excessive supply of the toner 30) at the time of printing due to excessive charge (excessive charge amount to the toner 30 due to excessive stress).

So, in this embodiment, conditions of the press-contact forces A1 and A2 that the quality of development processing and image forming becomes excellent (state in which blurring and/or contamination hardly occurs on the printed sheet P) are obtained by experiments, and the explanation will be made so as to constitute such that the press-contact forces A1 and A2 of the supply rollers 251 and 252 fall within the range. The details of experiments for obtaining the combination of the press-contact forces A1 and A2 which results in excellent quality of the development processing and the image forming (state in which blurring or contamination hardly occurs on the printed sheet P) will be detailed later.

(A-2) Operation of Embodiment

Next, the operation of the printer 1 of this embodiment having the aforementioned structure will be explained.

First, using FIG. 1, the operation of the entire printer 1 will be explained.

The printer 1 drives the development apparatuses 2K, 2C, 2M, and 2Y after receiving the print data, and resupplies the toner 30K, 30C, 30M, and 30Y from the toner cartridge 3K, 3C, 3M, and 3Y. After receiving the print data, a sheet P in the sheet feeding cassette 6 is fed and carried along the carrying path 8. The carried sheet P sequentially passes below the development apparatuses 2K, 2C, 2M, and 2Y, and the toner image on the photosensitive drums 21K, 21C, 21M, and 21Y formed by being exposed by the LED heads 5K, 5C, 5M, and 5Y is transferred by the transfer unit 4 and fused at the fuser unit 7. Thereafter, the sheet is ejected outside the printer 1.

The fundamental operation of the development apparatus 2K, 2C, 2M, and 2Y alone is the same, and therefore the following explanation will be directed to one development apparatus 2.

The surface of the photosensitive drum 21 is evenly electrically-charged by the charge roller 22, and an electrostatic latent image is formed by the light irradiated by the exposure unit 5.

The charge roller 22 is connected by a charge roller power source, which is not illustrated, for applying a bias voltage having the same polarity as the toner 30. The charge roller 22 evenly electrically-charges the surface of the photosensitive drum 21 by the bias voltage applied from the charge roller power source.

The development roller 23 is connected by a development roller power source, which is not illustrated, for applying a bias voltage having the same polarity as that of the toner 30 or the polarity opposite to that of the toner 30. The development roller 23 makes the charged toner 30 adhere to the electrostatic latent image portion on the photosensitive drum 21 by the bias voltage applied from the development roller power source.

The development blade 24 is connected by a development roller power source or a supply roller power source, which are not illustrated, for applying a bias voltage having the same polarity as that of the toner 30 or the polarity opposite to that of the toner 30. The development blade 24 charges the toner 30 on the development roller 23 and controls forming of a toner layer by the applied bias voltage and the contact-pressure at the time of contact.

The supply rollers 251 and 252 are each connected by a supply roller power source, which is not illustrated, for applying a bias voltage having the same polarity as that of the toner 30 or the polarity opposite to that of the toner 30. The supply rollers 251 and 252 supply the toner 30 replenished from the supply toner accommodation section 31 equipped by the toner cartridge 3 by the bias voltage applied from the supply roller power source to the development roller 23. Further, the supply rollers 251 and 252 charge the toner 30 by the frictional force between the supply roller and the development roller 25 and scrape the undeveloped toner on the development roller 23.

The cleaning blade 26 cleans the surface of the photosensitive drum 21 by scraping the toner 30 remained on the surface of the photosensitive drum 21. Further, the cleaning blade 26 also cleans adhered substances adhered to the surface of the photosensitive drum 21 from the transfer belt 9 although the amount is minute.

The carrying means 27 carries the remaining toner 30 and adhered substances removed by the cleaning blade 26 as waste toner 30 toward a front side of the photosensitive drum 21 in the rotation axis direction. The waste toner 30 carried by the carrying means 27 is carried to the waste toner accommodation section via the carrying path in the development apparatus 2 frame which is not illustrated.

The toner supply port 253 is a connection opening for supplying the toner 30 supplied from the toner cartridge 3 to the development apparatus 2 and is opened with a predetermined size.

The toner stirring mechanism 254 stirs the toner received by the toner receiving part 255 at both ends in the axial direction.

The toner receiving part 255 receives a part of the toner 30 supplied from the toner supply port 253 so that the toner stirring mechanism 254 stirs the toner.

The toner cartridges 3K, 3C, 3M, and 3Y are each provided with a stirring supply mechanism, which is not illustrated, in the toner accommodation section 31K, 31C, 31M, and 31Y, and replenish unused toners 30K, 30C, 30M, and 30Y into the development apparatuses 2K, 2C, 2M, and 2Y, respectively.

The transfer roller 4K, 4C, 4M, and 4Y of the transfer units 4 is connected by a transfer roller power source, which is not illustrated, for applying a bias voltage having the polarity opposite to that of the toner 30K, 30C, 30M, 30Y, so that the toner image formed on the photosensitive drum 21K, 21C, 21M, and 21Y is transferred to the sheet P by the bias voltage applied from the transfer roller power source.

The LED head 5K, 5C, 5M, and 5Y irradiates, based on the input print data, the light onto the surface of the photosensitive drum 21K, 21C, 21M, and 21Y to form an electrostatic latent image by light-attenuating the potential of the light irradiated part.

The sheet P fed in the sheet feeding cassette 6 is carried to the position below the development apparatus 2 by the carrying rollers, which are not illustrated.

In the fuser unit 7, based on the detection of the surface temperature of the heat application roller 7*a* detected by the thermistor, the heat application heater is controlled so that the surface temperature of the heat application roller 7*a* is maintained at a predetermined temperature. The sheet P on which the toner image is transferred passes through a press-contact portion formed by the heat application roller 7*a* in which the predetermined temperature is maintained and the pressure application roller 7*b*, thereby applying a heat and a pressure to the sheet P. Thus, the toner image on the sheet P is fused.

Next, the experimental results of the experiments actually performed using the development apparatus 2 (hereinafter referred to as "this experiment") will be explained with reference to FIGS. 6 and 7. This experiment is an experiment for mainly verifying combinations of appropriate values of the press-contact forces A1 and A2. Hereinafter, each condition of this experiment will be described, but each following condition is an example capable of obtaining an excellent result (exerting a specific result) at the time of realizing the development apparatus of the present invention, and does not limit the structure of the development apparatus of the present invention.

In this experiment, as the conductive foamed layer 251*b* and 252*b* of the supply roller 251 and 252, a substance in which silicone rubber pound as a base is foamed was used. The cell C of the conductive foamed layer 251*b* and 252*b* was an independent foam. The size of each cell C constituting the conductive foamed layer 251*b* and 252*b* is generally 100 to 1,000 μm. In this experiment, a cell having a size of 200 to 400 μm on the surface of the conductive foamed layer 251*b* and 252*b* was used. Further, as to the resistance value of the supply roller 251 and 252, when a SUS ball bearing having a width of 2.0 mm and a diameter of 6.0 mm was brought into contact with the supply roller 25 with a force of 20 gf and 300 V was applied from the shaft 251*a* and 252*a* while rotating the supply roller 25, it was preferable to adjust such that the supply roller had a resistance of 0.1 to 100 MΩ. In this experiment, the resistance value was set to 1 MΩ.

Further, in this experiment, as shown in the above-explained FIG. 4, the full width of the conductive foamed layer 251*b* and 252*b* was set to 220 mm. Further, the conductive foamed layer 251*b* and 252*b* having a straight shape in which the outer diameter was 14.0 mm at any positions was used. In this experiment, in advance, it was confirmed that the outer diameter (outer diameter of the supply roller 251 and 252) of the conductive foamed layer 251*b* and 252*b* was 14.0 mm measured at any one of three positions, i.e., the position D1 (position of 5.0 mm from D0), D2 (position of 110.0 mm from D0), and D3 (position of 215.0 mm from D0) with reference to the reference positon D0 as shown in FIG. 4.

In this experiment, the circumferential speed ratios at the time of rotating the photosensitive drum 21, the development roller 23 and the supply rollers 251 and 252 were set as shown in FIG. 5. In this experiment, on the basis (1.000) of the circumferential speed of the photosensitive drum 21, the circumferential speed ratio of the development roller 23 was set to 1.257, the circumferential speed ratio of the downstream side supply roller 251 was set to 0.604, and the circumferential speed ratio of the upstream side supply roller 252 was set to 0.660. Further, in this experiment, on the basis (1.000) of the circumferential speed of the development roller 23, the circumferential speed ratio of the downstream side supply roller 251 was set to 0.480, and the circumferential speed ratio of the upstream side supply roller 252 was set to 0.525.

In this experiment, the NIP amounts Δ1 and Δ2 of the supply rollers 251 and 252 were set to between 0.2 mm and 1.5 mm, respectively. Further, in this experiment, the layer thicknesses t1 and t2 of the supply rollers 251 and 252 were set to between 2.0 mm and 6.0 mm, respectively. Further, in this experiment, the hardness Hs1 and Hs2 (Asker F hardness) of the supply rollers 251 and 252 were set to between 30 and 70, respectively.

In the development apparatus 2 used in this experiment, "w1" shown in FIG. 3 was set to 5.00 mm.

In this experiment, the press-contact forces A1 and A2 were set by the combinations shown in FIG. 6. In each combination of the press-contact forces, the print quality was evaluated in a state after executing the continuous durable printing (continuous printing on sheets P until the device specification life) by the printer 1.

In this experiment, the development apparatus 2 performed continuous durable printing for the purpose of realizing a printer having a specification in which the life was 72,000 drum counts. The aforementioned drum count is set such that one rotation of the photosensitive drum 21 counts up by one. In this experiment, as a sheet P (evaluation sheet P (medium)), a printing sheet "Xerox 4200 LT 201b New92" made by XEROX® Corporation was used. Further, in this experiment, with this printer (printer to which the aforementioned development apparatus 2 was applied), a print pattern of black (K) toner of 1.25% with respect to the printable region of the sheet P was printed by intermittent printing every page up to the drum counts of 72,000. Further, in this experiment, using the printer, printing was performed up to the drum counts of 72,000 (life of the photosensitive drum 21), and evaluated as follows: the evaluation result was shown by "3" when no problem occurred in print quality in the sample (combination of press-contact forces A1 and A2); the evaluation was shown by "2" when slight problems occurred in print quality in the sample (sample having a degree of blurring and contamination equal to or smaller than a predetermined degree); and the evaluation was shown by "1" when big problems occurred in print quality in the sample (sample having a degree of blurring and contamination equal to or larger than a predetermined degree).

Concretely, in this example, after printing by the printer 1 under the conditions of each sample, using the printer 1, printing was performed at three stage densities, i.e., 100% solid printing with a toner of black (K) (an image with the highest density of K was printed in the entire printable region), a middle tone printing (an image with an intermediate density (50%) of K was printed in the entire printable region), and a while printing (an image with the lowest density (0%) of K was printed in the entire printable region), and the evaluations on contamination and fading about the printed sheet P were performed.

In this experiment, about the print results of each sample, about the contamination and fading, the evaluation result (any one of 1, 2, and 3) was obtained. In this experiment, as to the samples in which the evaluation of contamination and that of fading were 3, respectively, the final evaluation of the sample was regarded as 3, and as to the sample in which the evaluation of contamination and that of fading were 1 or 2, the lowest evaluation result was regarded as the final evaluation result. For example, as to the sample in which the evaluation of contamination was 3 and the evaluation of fading was 2, the final evaluation was regarded as 2.

In this experiment, as to the sheet P in which a 100% solid printing of each sample was performed, using the density measuring device ("X-Rite 528" made by X-Rite Corporation), the degree of fading was measured based on the density level difference between the region where the density is highest in the page (printable region) and the region where the density is lowest in the page (region where fading occurred). In this experiment, the evaluation results on the fading of the sample in which the density level difference in the page was smaller than 0.01 was denoted as 3, the evaluation results on the fading of the sample in which the density level difference in the page was 0.01 or more but 0.02 or less was denoted as 2, and the evaluation results on the fading of the sample in which the density level difference in the page was larger than 0.02 was denoted as 3.

In this experiment, in each sample, about the sheet P in which the meddle tone printing was performed and the sheet P in which while printing was performed, the evaluation on contamination was performed visually. In this experiment, the contamination evaluation result of the sample in which no contamination was recognized in both the sheet P in which a medium tone printing was performed and the sheet P in which white printing was performed was denoted as 3. Further, in this experiment, the contamination evaluation result of the sample in which contamination was recognized in the sheet P in which a medium tone printing was performed and no contamination was recognized in the sheet P in which white printing was performed was denoted as 2. Further, in this experiment, the contamination evaluation result of the sample in which contamination was recognized in the sheet P in which at least while printing was performed was denoted as 1.

The table shown in FIG. 6 shows a total value (A1+A2) of the press-contact forces A1 and A2 of each sample (every combination of the press-contact forces A1 and A2) in this experiment. Further, the table shown in FIG. 7, the evaluation results of each sample (every combination of the press-contact forces A1 and A2) are shown.

Next, from the experiment results shown in FIG. 7, the relationship between the total value of the press-contact forces A1 and A2 based on this experiment and the evaluation result will be explained.

In this experiment, as shown in FIG. 7, it is understood that the evaluation results of 2 to 3 can be obtained within the range in which the total value of the press-contact forces A1 and A2 is 10 or more but 50 or less. Further, in this experiment, in the region where the total value (A1+A2) of the press-contact forces A1 and A2 is less than 10, contamination due to insufficient print scraping and/or fading due to insufficient supply occurred, and the evaluation results in all samples were 1. Further, in this experiment, in the region where the total value (A1+A2) of the press-contact forces A1 and A2 is larger than 50, stress to the toner 30 increased, resulting in occurrence of contamination due to excessive charging, vertical steaks due to parts abrasion, and fading, etc., occurred, and the evaluation results in all samples were 1.

Therefore, in the printer 1 (development apparatus 2), by setting the press-contact forces A1 and A2 (Hs1, Δ1, t1, Hs2, Δ2, and t2) of the supply roller 251 and 252 so as to satisfy the following formula (7), the print quality of the evaluation of at least 2 or more (2 to 3) can be maintained.

$$10 \leq Hs1 \times (\Delta 1/t1) + Hs2 \times (\Delta 2/t2) \leq 50 \quad (7)$$

Further, in this experiment, as shown in FIG. 7, even in the region in which the press-contact forces A1 and A2 satisfy the above formula (7), it is understood that samples having the evaluation result of 3 are included in the region in which all of the press-contact forces A1 and A2 are 5 or more but 25 or less.

Therefore, in the printer 1 (development apparatus 2), about the press-contact forces A1 and A2 (Hs1, Δ1, t1, Hs2, Δ2, and t2) of the supply roller 251 and 252, by setting so that the following formula (8) and formula (9) are satisfied in addition to the above formula (7), higher print quality can be maintained.

$$5 \leq Hs1 \times (\Delta 1/t1) \leq 25 \quad (8)$$

$$Hs2 \times (\Delta 1/t1) + Hs2 \times (\Delta 2/t2) \leq 50 \quad (9)$$

Even in the region in which the above formula (7) is satisfied, in cases where the press-contact force is large in either of the supply rollers 251 and 252, the abrasion of the supply roller which is large in press-contact force is large, and therefore problems on print quality easily occurs depending on the structure of the printer 1 (loaded model of the development apparatus 2). For this reason, by adding not only the above formula (7) but also the above formula (8) and formula (9) to the set conditions of press-contact forces A1 and A2 of the supply roller 251 and 252, it becomes possible to maintain higher print quality (decrease deterioration of the print quality due to abrasion of the supply roller, etc.).

Further, in this experiment, as shown in FIG. 7, even in the region in which the press-contact forces A1 and A2 satisfy the above formulas (7) to (9), it is understood that the evaluation results of all of the samples are 3 in the region in which the press-contact force A2 of the upstream side supply roller 252 is a value equal to or larger than the press-contact force A1 of the downstream side supply roller 251.

Therefore, in the printer 1 (development apparatus 2), as to the press-contact forces A1 and A2 (Hs1, Δ1, t1, Hs2, Δ2, and t2), by setting so as to satisfy the following formula (10) in addition to the aforementioned formulas (7) to (9), it becomes possible to maintain much higher print quality can be maintained.

$$Hs1 \times (\Delta 1/t1) \leq Hs2 \times (\Delta 2/t2) \quad (10)$$

(A-3) Effects of Embodiment

According to this embodiment, the following effects can be exerted.

In this printer 1 (development apparatus 2) according to this embodiment, as to the press-contact forces A1 and A2 (Hs1, Δ1, t1, Hs2, Δ2, and t2), by structuring so as to satisfy the aforementioned formula (7), it becomes possible to maintain the excellent print quality (print quality of the evaluation result of at least 2 or more) for a long period of time (until at least the life of the photosensitive drum 21).

Further, in the printer 1 (development apparatus 2) of the embodiment, about the press-contact forces A1 and A2 (Hs1, Δ1, t1, Hs2, Δ2, and t2) of the supply roller 251 and 252, by setting so that the aforementioned formula (8) and formula (9) are satisfied in addition to the above formula (7), higher print quality can be maintained for a long period of time (until at least the life of the photosensitive drum 21).

Further, in the printer 1 (development apparatus 2) of the embodiment, about the press-contact forces A1 and A2 (Hs1, Δ1, t1, Hs2, Δ2, and t2) of the supply roller 251 and 252, by setting so that the aforementioned formula (10) is satisfied in addition to the above formulas (7) to (9), much higher print quality can be maintained for a long period of time (until at least the life of the photosensitive drum 21).

(B) Another Embodiment

The present invention is not limited to the aforementioned embodiment, and the following modified embodiments can be exemplified.

(B-1) In the aforementioned embodiment, although an example in which the development apparatus of the present invention is applied to the development apparatus 2 including structural elements other than the development roller 23 and the supply rollers 251 and 25 was explained, the present invention can be applied to another development apparatus including at least the development roller and the supply roller (the press-contact force is set in the same manner as in the aforementioned embodiment).

(B-2) In the aforementioned embodiment, although an example in which the development apparatus of the present invention is applied to an image forming apparatus as a printer was explained, the present invention can be applied to another image forming apparatus such as a photocopier (copier) or a multifunction machine (MFP), FAX, etc.

Radii (r1, r2, r3) of the rollers (23, 251, 252) can be determined considering conditions and features of the rollers. One example is disclosed below r1=7.95 (cm)

r2=7 (cm)

r3=7 (cm)

The development roller 23 can be larger than the supply rollers 251 and 252. The supply rollers 251 and 252 can have the same radius.

A roller relation angle θx, which is shown in FIG. 1, is also determined to be within a certain range considering conditions and features of the rollers, the roller relation angle θx being defined as an angle around the rotation axis P1 surrendered by two connection lines. One line passes through the rotation axes P1 and P2. The other line passes through the rotation axes P1 and P3. One example of the roller relation angle θx is 65 degrees. At least, it is practical for the roller relation angle θx to be ranged within 60 to 70 degrees.

What is claimed is:

1. A development apparatus comprising:

an electrostatic latent image carrier configured to hold an electrostatic latent image on a surface thereof while rotating;

a developer carrier configured to develop the electrostatic latent image using a developer while rotating;

a developer accommodation section configured to accommodate the developer; and a first and second developer supply members each configured to supply the developer accommodated in the developer accommodation section to the developer carrier while rotating, wherein the first developer supply member and the second developer supply member are each arranged at positions opposite to the developer carrier so as to come into press-contact with the developer carrier, the first developer supply member is arranged on a downstream side of the developer carrier in a rotation direction than the second developer supply member, an elastic layer is formed on an outer peripheral surface of each of the first developer supply member and the second developer supply member, and Hs1, Δ1, t1, Hs2, Δ2, and t2 satisfy a following formula (A), $$10 \leq Hs1 \times (\Delta 1/t1) + Hs2 \times (\Delta 2/t2) \leq 50 \quad (A)$$

where

Hs1 is a hardness of the outer peripheral surface of the first developer supply member, t1 is a layer thickness of the elastic layer of the first developer supply member, Δ1 is an NIP amount that is determined when the first developer supply member is in press-contact with the developer carrier, Hs2 is a hardness of the outer peripheral surface of the second developer supply member, t2 is a layer thickness of the elastic layer of the second developer supply member, and Δ2 is an NIP amount that is determined when the second developer supply member is in press-contact with the developer carrier.

2. The development apparatus according to claim 1, wherein

Hs1, Δ1, t1, Hs2, Δ2, and t2 further satisfy following formulas (B) and (C):

$$5 \leq Hs1 \times (\Delta 1/t1) \leq 25 \quad \text{(B); and}$$

$$5 \leq Hs2 \times (\Delta 2/t2) \leq 25 \quad \text{(C).}$$

3. The development apparatus according to claim 2, wherein

Hs1, Δ1, t1, Hs2, Δ2, and t2 further satisfy following formula (D):

$$Hs1 \times (\Delta 1/t1) \leq Hs2 \times (\Delta 2/t2) \quad \text{(D).}$$

4. An image forming apparatus comprising:

an electrostatic latent image carrier for holding an electrostatic latent image on a surface thereof while rotating; and a development apparatus for developing the electrostatic latent image of the electrostatic latent image carrier, wherein the development apparatus is a development apparatus according to claim 1.

* * * * *